US005904038A

United States Patent [19]

Stahlecker

[11] Patent Number: 5,904,038

[45] Date of Patent: May 18, 1999

[54] SUPPORTING DISK FOR A SUPPORTING DISK BEARING OF AN OPEN-END SPINNING ROTOR AND METHOD OF MAKING SAME

[75] Inventor: Gerd Stahlecker, Eislingen, Germany

[73] Assignee: Novibra GmbH, Suessen, Germany

[21] Appl. No.: 09/042,151

[22] Filed: Mar. 13, 1998

[30] Foreign Application Priority Data

Mar. 27, 1997 [GB] United Kingdom ..... 197 12 916

[51] Int. Cl.[6] ..... D01H 4/00

[52] U.S. Cl. ..... 57/406; 57/404; 384/566; 384/588; 384/549

[58] Field of Search ..... 384/120, 549, 384/557, 563, 566–588; 57/404, 406, 407

[56] References Cited

U.S. PATENT DOCUMENTS

| | | | |
|---|---|---|---|
| 4,676,673 | 6/1987 | Stahlecker et al. | 384/549 |
| 4,892,422 | 1/1990 | Stahlecker | 57/406 |
| 4,896,976 | 1/1990 | Stahlecker | 384/549 |
| 5,178,473 | 1/1993 | Oexler et al. | 384/549 |
| 5,221,133 | 6/1993 | Braun et al. | 384/549 |
| 5,362,160 | 11/1994 | Braun et al. | 384/549 |
| 5,423,616 | 6/1995 | Gotz | 384/549 |
| 5,551,226 | 9/1996 | Keir et al. | 57/406 |

FOREIGN PATENT DOCUMENTS 33 42 768 6/1985 Germany .

*Primary Examiner*—William Stryjewski
*Attorney, Agent, or Firm*—Evenson McKeown Edwards & Lenahan, PLLC

[57] ABSTRACT

Supporting disks are provided for a supporting disk bearing for open-end spinning rotors, which supporting disks have an essentially cylindrical running surface defined by encircling border edges. The running surface is provided with a helically shaped groove comprising at least two turns. The starting point of the groove as well as the end thereof have an eased runout which is at a distance to the respective border edge.

14 Claims, 2 Drawing Sheets

SUPPORTING DISK FOR A SUPPORTING DISK BEARING OF AN OPEN-END SPINNING ROTOR AND METHOD OF MAKING SAME

BACKGROUND AND SUMMARY OF THE INVENTION

This application claims the priority of foreign application No. 197 12 916.1 filed in Germany on Mar. 27, 1997, the disclosure of which is expressly incorporated by reference herein.

The present invention relates to a supporting disk for a supporting disk bearing of an open-end spinning rotor comprising a damping, essentially cylindrical running surface defined by encircling border edges, which running surface comprises a helically shaped groove having a beginning and an end.

The U.S. Pat. No. 5,551,226 teaches that in the case of the known supporting disk of this type, the beginning and end of the helically shaped groove are located on the border edges which define the running surface. As during operation, the open-end spinning rotor exerts its greatest load on the border edges, the danger exists that the edges of the damping running surface, which is made of plastic, will crumble as a result of the interruptions on the surface caused by the groove.

German published patent application 33 42 768 teaches a similar supporting disk, in which the helically shaped groove has only one thread. The groove extends to both border edges, so that here also the same danger as in the above mentioned prior art exists.

One purpose of both known helically shaped grooves is to prevent the running surfaces heating up excessively during operation thus preventing that in the center of the running surface heat damage which could destroy the running surface.

It is an object of the present invention to eliminate the risk of the supporting disks of the above mentioned type crumbling at the border edges.

This object has been achieved in accordance with the present invention in that the beginning and the end of the helical groove are provided with an eased runout, which is located at a distance from the respective border edge.

The beginning and end of the groove are thus still located according to the present invention on the cylindrical running surface, whereby at both points the groove gradates over from the groove base into the running surface. The helically shaped groove thus does not extend to the extremely loaded border edges, so that damage of the running surface, in the form of crumbling, is prevented at these points.

For this purpose, the two eased runouts are located diametrically opposed to one another. Thus imbalances, which could be caused by the gradation of the helically shaped groove into the running surface, are avoided.

The groove is advantageously provided with two and a half helical turns. This is a good compromise between two loads which are not compatible, namely operational temperature and surface pressure. From experience, it is known that, with a higher number of thread turns, the heat build-up of the running surface is reduced. On the other hand, the stress bearing area of the running surface is reduced by the number of thread turns, which results in a higher surface pressure by the open-end rotor.

In order that the whole width of the running surface can be used to a large extent, it is further provided that the distance of the eased runouts from the respective border edges measures approximately 1 mm.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
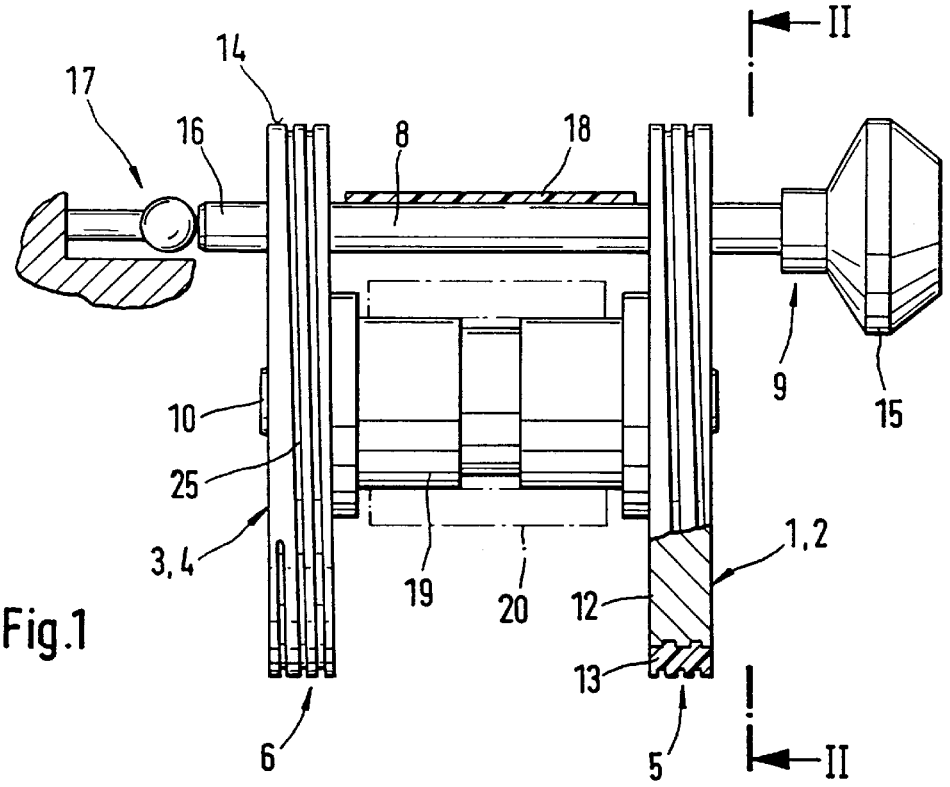
FIG. 1 is a partly intersected longitudinal view of a supporting disk bearing comprising supporting disks according to the present invention.
Figure 2:
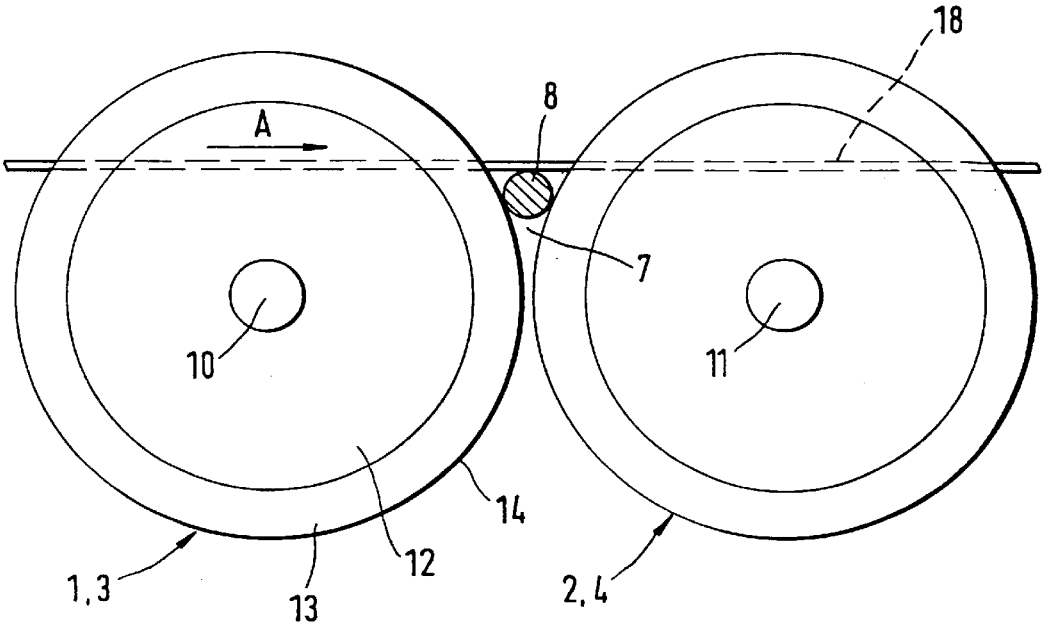
FIG. 2 is a view taken along section plane II—II of FIG. 1.

The supporting disk bearing shown in FIGS. 1 and 2 comprises four supporting disks 1,2,3 and 4, which are arranged in pairs. The two pairs 5 and 6 form wedge-shaped gaps 7, in which a shaft 8 of an open-end spinning rotor 9 is supported in a known way. The supporting disks 1,3;2,4 as far as they are located on the same side of the shaft 8 are arranged on a joint axle 10 or 11.

The supporting disks 1,2,3 and 4 are essentially similarly designed. They each comprise preferably a metal, disk-shaped base body 12, whose outer circumference is provided with a damping ring or tire 13. The four damping rings 13 form each an essentially cylindrical running surface 14 for the shaft 8 of the open-end spinning rotor 9. Each damping ring 13 consists of an elastomer plastic.

The shaft 8 of the open-end spinning rotor 9 supports at one end a rotor cup 15. The other end of the shaft 8 is supported in axial direction against a step bearing 17 which is only schematically shown.

The shaft 8 is loaded with a tangential belt 18 which extends in direction A in longitudinal direction of the open-end spinning machine, and thereby drives the open-end spinning rotors 9 of a plurality of spinning stations of at least one machine side.

The supporting disk bearing is so arranged that it is suitable for speeds of the open-end spinning rotor 9 of more than 130,000 rpm. The diameter of the shaft 8 measures hereby in the order of 8 mm. The supporting disks 1,2,3 and 4 have an outer diameter of preferably 78 mm on their running surfaces 14. The thickness of the damping ring 13 is adapted to this outer diameter, thus measuring 4 mm. The width of the running surface 14 measures about 8 mm.

The supporting disks 1,2,3 and 4 are each provided with a centrical bore hole (not shown), by means of which they are placed on the respective axle 10 or 11. The axles 10 and 11 are in turn each taken up in a bearing housing 19, to which a joint bearing support 20, denoted only by a dot-dash line, is arranged, which bearing support 20 is applied to the machine frame.

Figure 3:
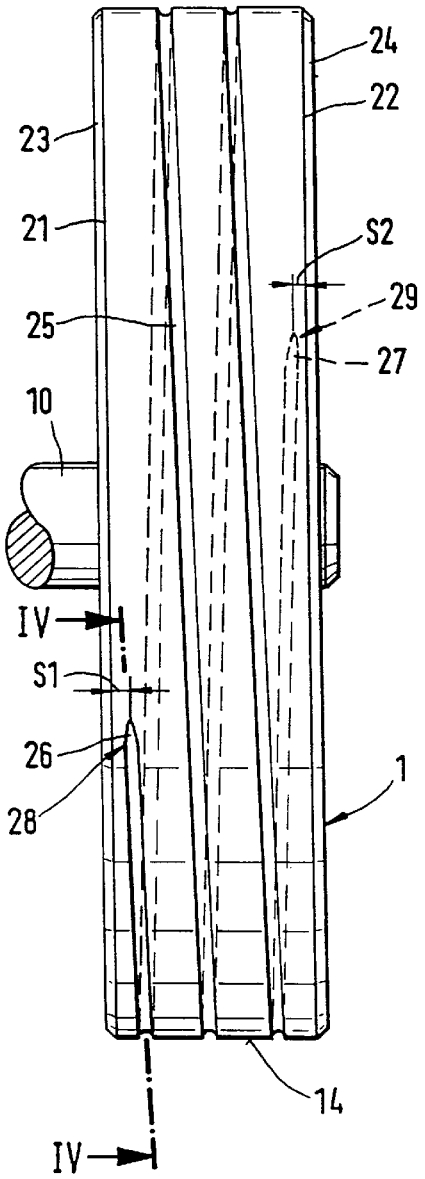
FIG. 3 is a greatly enlarged part view of supporting disk from FIG. 1 constructed according to a preferred embodiment of the present invention.
Figure 4:
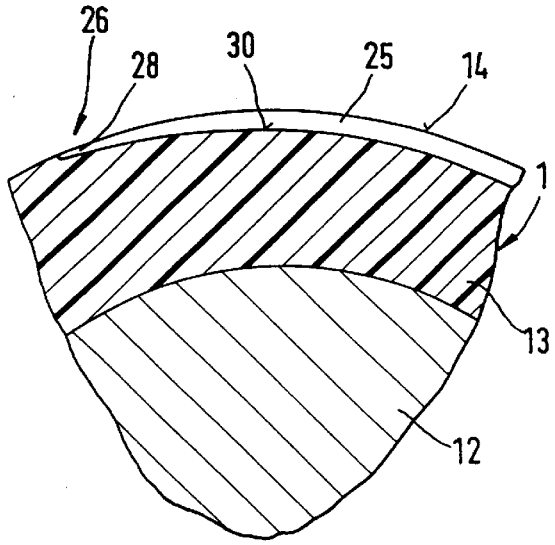
FIG. 4 is a view of the supporting disk along the section plane IV—IV of FIG. 3.

FIGS. 3 and 4 show a greatly enlarged supporting disk 1, whereby this could, of course, also be any one of the other supporting disks 2, 3, or 4. This supporting disk 1 is, in comparison to its diameter, shown with an exaggerated width, so that the present invention is more clearly presented.

As can be seen in particular from FIG. 3, the running surface 14 is defined on both sides by border edges 21 and 22 which extend in circumferential direction. Bevelled sections 23 and 24 may be present adjacent to these border edges 21 and 22, which graduate over into the front or end face surfaces (no reference number) of the supporting disk 1.

The running surface 14 is provided with a helically shaped groove 25, which in the embodiment shown according to FIG. 3 is preferably provided with two and a half helical turns. The beginning 26 and the end 27 of the groove 25 are each provided with a so-called eased runout 28 or 29 which can be seen in particular in FIG. 4. The two eased runouts 28 and 29 end on the running surface 14, that is the cylindrical circumferential surface, namely at a distance s1 and s2 from the respective border edges 21 and 22. In practical embodiments, the distance s1 is equal to s2 which can be in the order of 1 mm.

Although the helically shaped groove 25 in the shown embodiment has two and a half helical turns, three and a half or more turns can also be provided according to other contemplated embodiments. What is important, however, is that the eased runouts 28 and 29 of these threads are each diametrically opposed to one another, so that the supporting disk 1 is counterbalanced.

The helically shaped groove 25 comprises a groove bottom 30, which lies approximately 2 mm deeper than the running surface 14. The groove width is of the order of 1 mm. The groove 25 can be V-shaped, square, or semicircular in shape in cross section.

It has been shown that a helically shaped groove 25 comprising two and a half helical turns is a good compromise between reduced heat build-up and surface pressure. As already mentioned, these two parameters of heat buildup and surface pressure are not compatible during operation.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A supporting disk for a supporting disk bearing of an open-end spinning rotor comprising a damping, essentially cylindrical running surface defined by encircling border edges, which running surface is provided with a helically shaped groove having a beginning and an end and comprising at least two turns, wherein the beginning and the end of the groove is provided with an eased runout, which has a distance from the respective border edge.

2. A supporting disk according to claim 1, wherein the two eased runouts are diametrically disposed opposite one another.

3. A supporting disk according to claim 1, wherein two and a half turns are provided for the groove.

4. A supporting disk according to claim 3, wherein the distance from the respective border edge measures approximately 1 mm.

5. A supporting disk according to claim 2, wherein the distance from the respective border edge measures approximately 1 mm.

6. A supporting disk according to claim 2, wherein two and a half turns are provided for the groove.

7. A supporting disk according to claim 6, wherein the distance from the respective border edge measures approximately 1 mm.

8. A supporting disk according to claim 1, wherein the distance from the respective border edge measures approximately 1 mm.

9. A supporting disk according to claim 1, wherein the distance between the respective eased runouts and the respective border edges is sufficient to avoid crumbling of the border edges during in use operation of the supporting disks.

10. A method of making a supporting disk for a supporting disk bearing of an open-end spinning rotor, comprising:

providing a metal disk-shaped base body; and forming a damping ring of elastomer plastic and applying said damping ring to the base body, wherein said forming a damping ring includes providing a helically shaped groove having a beginning and end and comprising at least two helical turns around said damping ring, and wherein each of the beginning and the end of the helical groove is provided with an eased runout terminating at the circumference of the damping ring and spaced a distance from respective axial border edges of the damping ring.

11. A method according to claim 10, wherein the distance between the respective eased runouts and the respective border edges is sufficient to avoid crumbling of the border edges during in use operation of the supporting disks.

12. A method according to claim 11, wherein two and a half helical turns are provided for the groove.

13. A method according to claim 10, wherein the two eased runouts are diametrically disposed opposite one another.

14. A method according to claim 10, wherein two and a half helical turns are provided for the groove.

* * * * *